US006260559B1

(12) United States Patent
Schirren et al.

(10) Patent No.: US 6,260,559 B1
(45) Date of Patent: Jul. 17, 2001

(54) METHOD AND APPARATUS FOR HAIR STYLING

(76) Inventors: Maria G. Schirren, Grillenweg 18, 22523 Hamburg (DE); Maria L. Flores, 440 N. Post Oak La., Houston, TX (US) 77024

( * ) Notice: Subject to any disclaimer, the term of this patent is extended or adjusted under 35 U.S.C. 154(b) by 0 days.

(21) Appl. No.: 09/473,459

(22) Filed: Dec. 28, 1999

(51) Int. Cl.[7] ..... A45D 8/12
(52) U.S. Cl. ..... 132/275; 132/273
(58) Field of Search ..... 132/53, 54, 200, 132/201, 212, 275, 273, 246; D28/39, 40, 41

(56) References Cited

U.S. PATENT DOCUMENTS

| | | | | |
|---|---|---|---|---|
| 1,369,994 | * | 3/1921 | Weaver | 132/246 |
| 1,465,216 | * | 8/1923 | Heathcote | 132/246 |
| 1,619,743 | * | 3/1927 | McClaire | 132/246 |
| 1,643,226 | * | 9/1927 | Strabelle | 132/246 |
| 2,066,709 | * | 1/1937 | Adams | 132/246 |
| 5,167,245 | | 12/1992 | Harriett | 132/273 |
| 5,289,834 | | 3/1994 | Lawrence | 132/212 |
| 5,404,892 | | 4/1995 | Bretl | 132/200 |
| 5,417,230 | | 5/1995 | Wood | 132/212 |
| 5,497,795 | | 3/1996 | Hibbard | 132/200 |
| 5,687,751 | | 11/1997 | Villani | 132/200 |
| 5,713,218 | * | 2/1998 | McCabe | 132/275 |
| 5,806,538 | | 9/1998 | Keltner | 132/210 |
| 5,810,022 | | 9/1998 | Reynolds | 132/200 |
| 5,881,736 | * | 3/1999 | Turner et al. | 132/200 |
| 5,899,211 | * | 5/1999 | Brown | 132/201 |

* cited by examiner

*Primary Examiner*—Pedro Philogene
(74) *Attorney, Agent, or Firm*—Jackie Lee Duke

(57) ABSTRACT

A novel method and apparatus for hair styling is disclosed that allows a user to bind or retain hair in a particular orientation while allowing the user to then braid, twist or wind the hair as desired. The hair styling apparatus includes a wire center core spirally wound with a fabric strip such that the fabric strip acts as a sheath to substantially cover the wire center core. The wire center core is sized to be flexible so a user may bend or wind the hair styling apparatus as desired while having sufficient stiffness to retain the desired shape. The hair styling apparatus may be further enhanced by the addition of an elastic loop at one end to allow grouping a bundle of hair as in a pony tail. Additionally, the ends of the hair styling apparatus may be adorned with beads or other ornaments that are interchangeable with use of threaded end connections. Several methods of use for such a novel hair styling apparatus are shown.

13 Claims, 6 Drawing Sheets

602
600
100

604
100

604

604

METHOD AND APPARATUS FOR HAIR STYLING

BACKGROUND OF THE INVENTION

1. Field of the Invention

This invention relates to a novel method and apparatus for styling and retaining a user's hair in a preferred style. The method and apparatus of the current invention allow a user to bind or retain hair in a particular orientation while allowing the user to then braid, twist or wind the hair as desired.

2. Description of Related Art

A number of patents have been issued for various hair styling and wrapping methods and apparatuses.

An apparatus for hair tying and the method of its use is shown in U.S. Pat. No. 5,167,245 to D. S. Harriett that uses an elastic loop with a metal retainer clip. Another pony tail tool using an elastic loop is disclosed in U.S. Pat. No. 5,289,834 to L. D. Lawrence.

U.S. Pat. No. 5,404,892 to S. K. Bretl discloses an apparatus and method for decorating hair using a pronged clasp for attaching the ornamental piece. Another apparatus and method for decorating hair using sliding beads on an inner core are shown in U.S. Pat. No. 5,881,736 to P. J. Turner et al.

A hair styling tool is shown in U.S. Pat. No. 5,806,538 to T. L. Keltner. The tool includes a curved section with a hook at one end for use in creating a wrapped hair tail which gives the appearance that an individual's hair is the fastening means of the hair tail.

SUMMARY OF THE INVENTION

The current invention uses a novel method and apparatus to style and retain a user's hair in a preferred style. The method and apparatus of the current invention allow a user to bind or retain hair in a particular orientation while allowing the user to then braid, twist or wind the hair as desired.

According to the present invention, a hair styling apparatus is shown. The hair styling apparatus includes a wire center core spirally wound with a fabric strip such that the fabric strip acts as a sheath to substantially cover the wire center core. The wire center core may be a single wire or plurality of wires wound together. The wire center core is sized to be flexible so a user may bend or wind the hair styling apparatus as desired while having sufficient stiffness to retain the desired shape. The hair styling apparatus may be further enhanced by the addition of an elastic loop at one end to allow grouping a bundle of hair as in a pony tail. Additionally, the ends of the hair styling apparatus may be adorned with beads or other ornaments. In one embodiment, elastic loops, ornamental end pieces or clasps are made interchangeable with use of threaded end connections.

Several methods of use of such a novel hair styling apparatus are shown. One method uses the hair styling apparatus with an elastic loop on one end. A portion of a user's hair is formed into a pony tail and inserted into the elastic loop which then retains it. The hair styling apparatus is then wrapped around the pony tail. In another method, the hair styling apparatus with an elastic loop at one end is used to retain a top pony tail on a user's head. A third method of use is disclosed with the hair styling apparatus having a bead attached at each end. The hair styling apparatus is wrapped around a hair tail formed adjacent a user's temple. The wrapped hair tail is then wrapped over the user's head adjacent the user's forehead and secured to the user's hair adjacent the other temple.

A principal object of the present invention is to provide a hair styling apparatus that allows a user to bind or retain hair in a particular orientation while allowing the user to then braid, twist or wind the hair as desired.

Another object of the present invention is to provide a hair styling apparatus that may be easily modified for use with various hair styles and allows addition of ornamental end pieces.

A further object of the present invention is to provide various methods of styling a user's hair utilizing the hair styling apparatus of the present invention.

These with other objects and advantages of the present invention are pointed out with specificness in the claims annexed hereto and form a part of this disclosure. A full and complete understanding of the invention may be had by reference to the accompanying drawings and description of the preferred embodiments.

BRIEF DESCRIPTION OF THE DRAWINGS

These and other objects and advantages of the present invention are set forth below and further made clear by reference to the drawings, wherein.

DESCRIPTION OF THE PRESENTLY PREFERRED EMBODIMENTS

Figure 1:
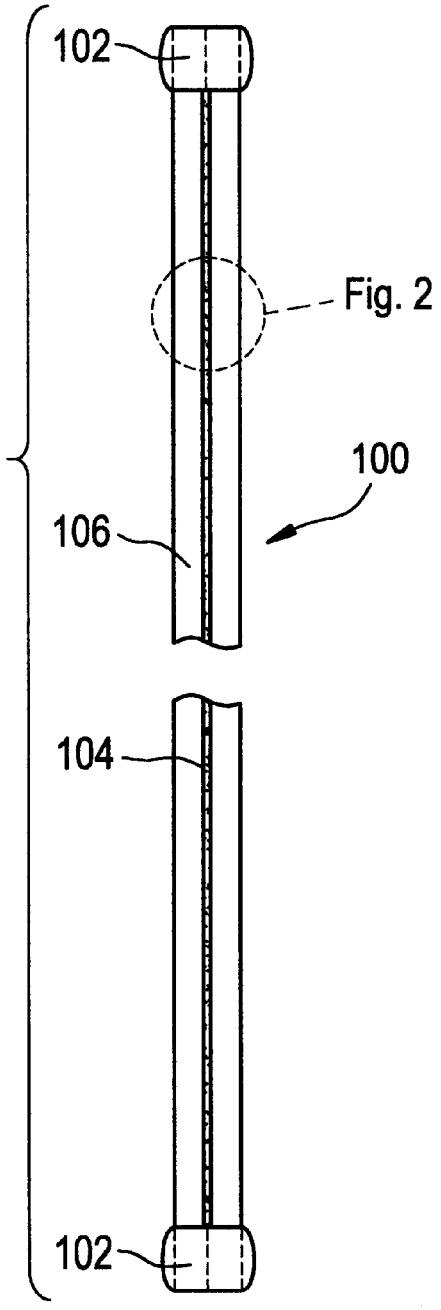
FIG. 1 is an elevation view of the hair styling apparatus of the present invention with a bead at each end.
Figure 2:
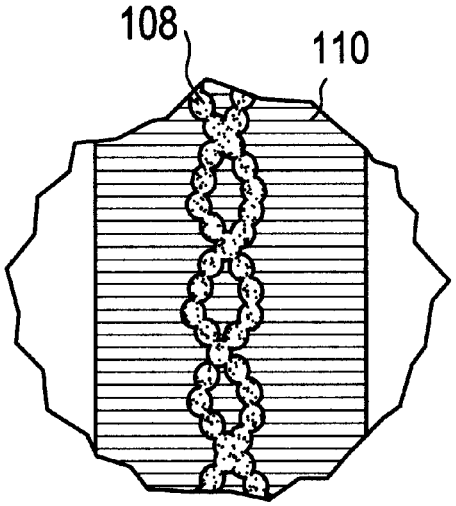
FIG. 2 is an enlarged view showing the details of construction of the central core of the elongate body of the hair styling apparatus.

With reference to the drawings, and particularly to FIG. 1, the hair styling apparatus 100 of the current invention is shown. Beads 102 are attached at each end by suitable retaining means as gluing. Hair styling apparatus 100 includes an elongate body 104 with a fabric covering or sheath 106. FIG. 2 shows the details of how elongate body 104 and fabric sheath 106 are formed. Elongate body 104 includes a plurality of elongate, inextensible members 108 such as thin wires that are wound, typically in a spiral fashion, to form a wire core with elongate fabric strip 110. Elongate fabric strip 110 is a material with a fringed or "fuzzy" texture so that the sheath 106 thus formed appears to have a fuzzy texture similar to that of a pipe cleaner and substantially covers the elongate body 104. Although, shown being formed with a plurality of elongate members 108, the current invention envisions and encompasses the use of a single wire of sufficient stiffness to form elongate body 104 also.

Figure 3:
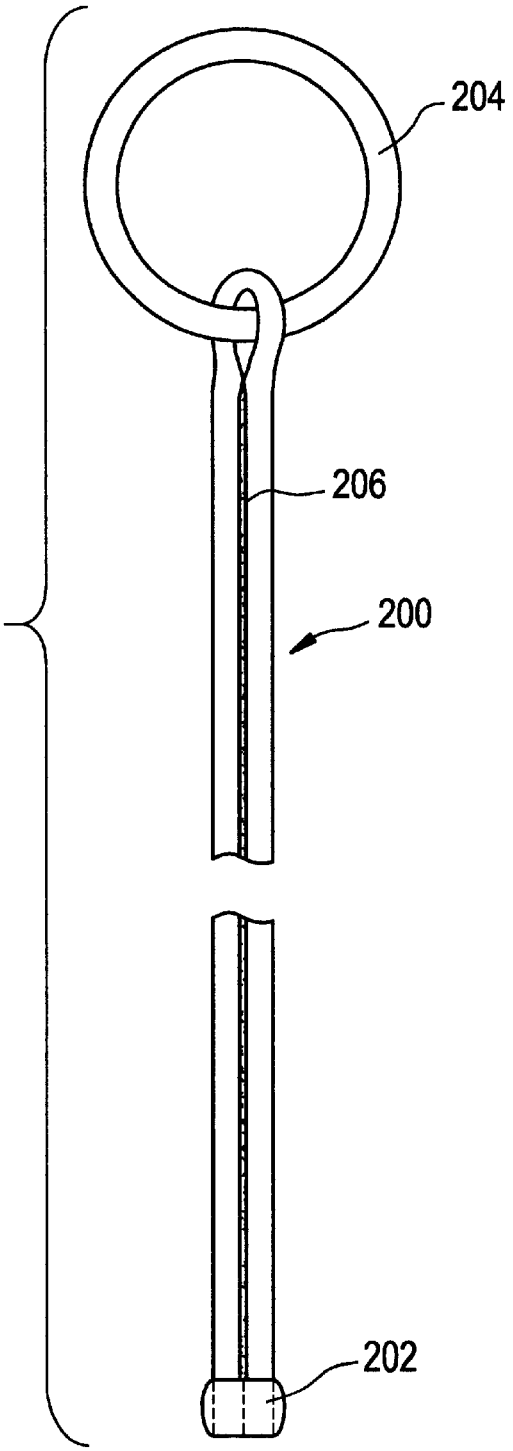
FIG. 3 is an elevation view of another embodiment of the hair styling apparatus of the present invention with a bead at one end and an elastic loop at the opposite end.
Figure 4:
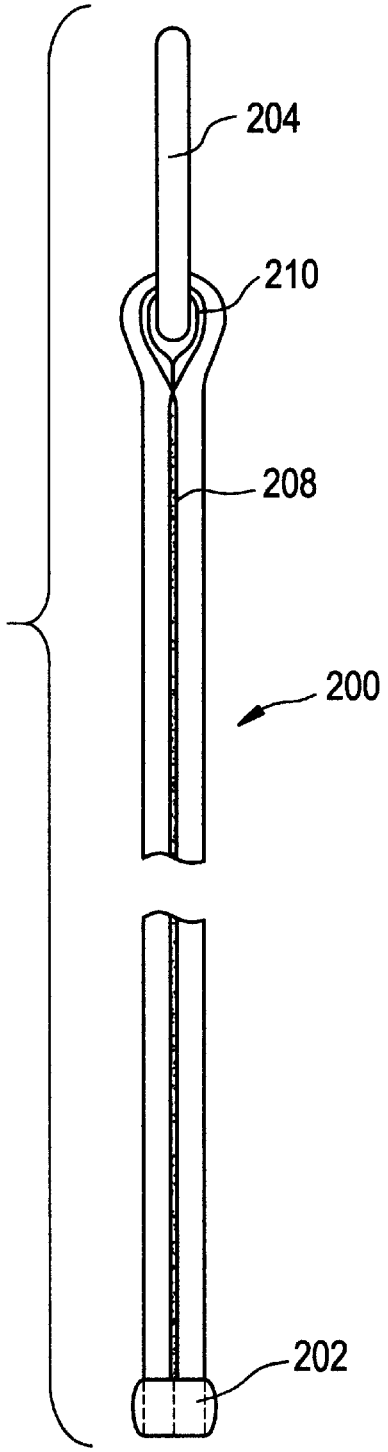
FIG. 4 is an elevation view of the embodiment of FIG. 3 perpendicular to FIG. 3.

A second embodiment of the present invention is shown in FIGS. 3 and 4. Hair styling apparatus 200 is shown with bead 202 are attached at one end by suitable retaining means as gluing and an elastic loop 204 at the opposite end. Hair styling apparatus 200 includes an elongate body 206 with a fabric covering or sheath 208. Elongate body 206 and sheath 208 are wound together as in the first embodiment. Elongate body 206 is then folded in half to form fold or loop 210. The first and second halves of elongate body 206 are then wound together with elastic loop 204 positioned in loop 210 to form a shapeable hair supporting member.

Figure 5:
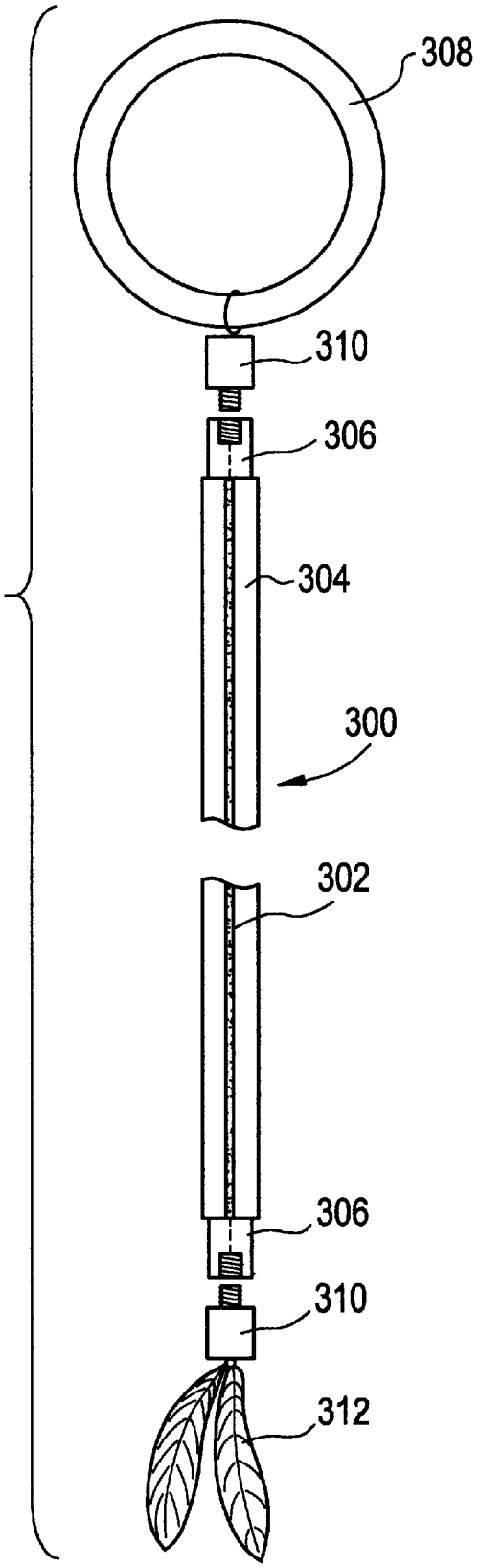
FIG. 5 is an elevation view of another embodiment of the hair styling apparatus of the present invention with an ornamental end piece at one end and an elastic loop at the opposite end showing the details of the interchangeable end connections.
Figure 6:
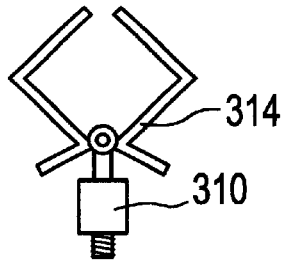
FIG. 6 is an elevation view showing an interchangeable hair clasp for use with the embodiment of FIG. 5.
Figure 7:
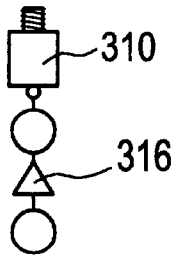
FIG. 7 is an elevation view showing an interchangeable ornamental end piece for use with the embodiment of FIG. 5.

A third embodiment of the present invention is shown in FIGS. 5–7. Hair styling apparatus 300 is shown and includes an elongate body 302 with a fabric covering or sheath 304. Elongate body 302 and sheath 304 are wound together as in the first embodiment. Each end of elongate body 302 has a female threaded connector 306 attached at each end by suitable means such as gluing or crimping. One end of elongate body 302 has elastic loop 308 attached thereto by male threaded connector 310. Similarly, the opposite end of elongate body 302 has ornament 312 attached thereto by male threaded connector 310. The use of female threaded connectors 306 on elongate body 302 allows the interchange of end pieces on elongate body 302 such as hair clasp 314 shown in FIG. 6 or alternate ornament 316 shown in FIG. 7.

Figure 8C:
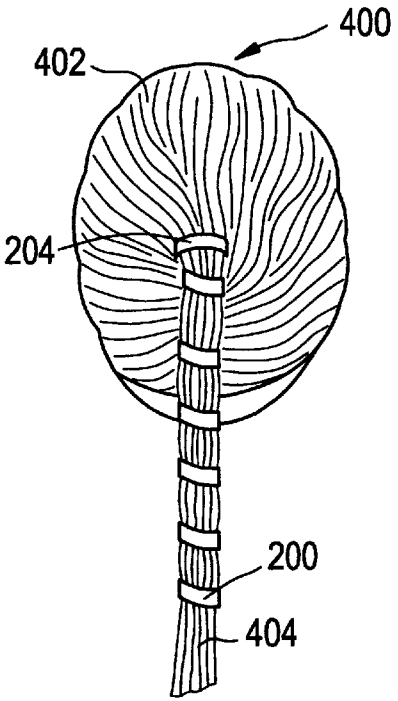
FIGS. 8A–8C are perspective views showing a method of use of the hair styling apparatus of the present invention with a pony tail.
Figure 8B:
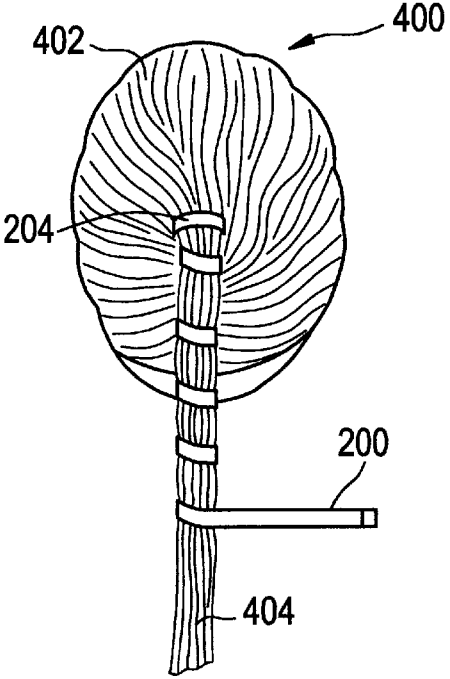
Figure 8A:
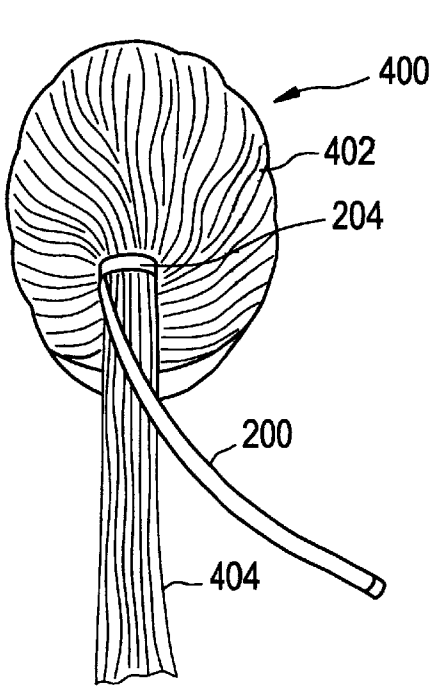

A typical sequence of steps for practicing the current invention utilizing the above described apparatuses would be as follows. As best seen in FIGS. 8A–8C, the hair styling apparatus 200 of FIGS. 3 and 4 is shown being used to form and wrap a user's pony tail. The rear of a user's head 400 is shown with hair 402. A portion of user's hair 402 is formed into pony tail 404 and inserted through elastic loop 204 in FIG. 8A. Elastic loop 204 is slid to the upper end of pony tail 404 in FIG. 8B and then hair styling apparatus 200 is wound around pony tail 404 to give a wrapped, stylish appearance in FIG. 8C.

Figure 9C:
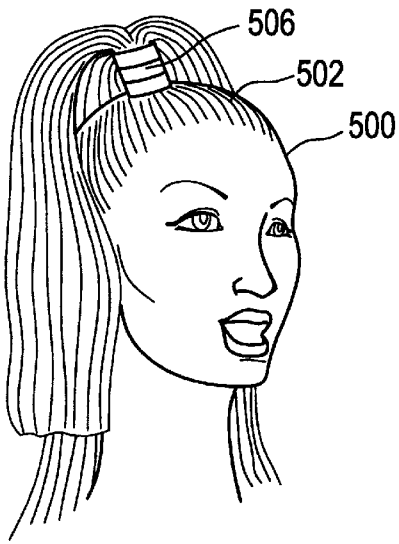
FIGS. 9A–9C are perspective views showing a method of use of the hair styling apparatus of the present invention with a top pony tail.
Figure 9B:
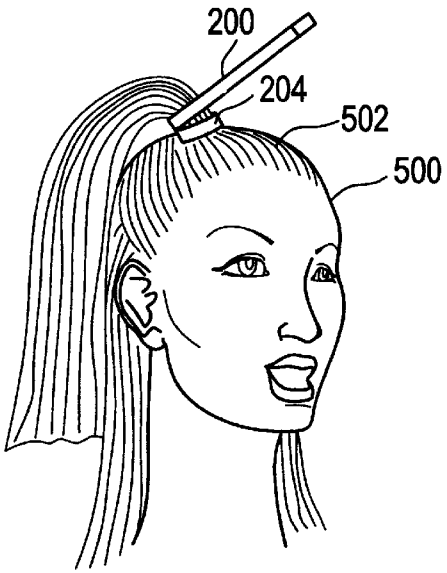
Figure 9A:
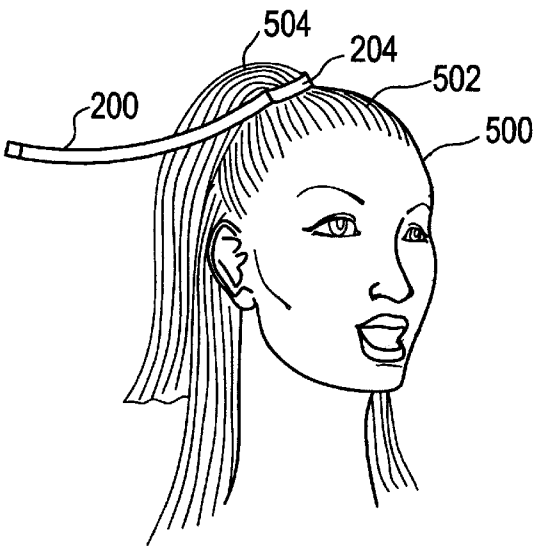

A typical sequence of steps for practicing a second method of the current invention is best seen in FIGS. 9A–9C. The hair styling apparatus 200 of FIGS. 3 and 4 or the hair styling apparatus 300 of FIGS. 5–7 may be used to practice this method. A front view of a user's head 500 is shown with hair 502. A portion of user's hair 502 is formed into top pony tail 504 and inserted through elastic loop 204 in FIG. 9A. Elastic loop 204 is slid to the inner end of pony tail 504 in FIG. 9B. Hair styling apparatus 200 is wound around pony tail 504 to form adjacent loops 506 and to retain top pony tail 504 as shown in FIG. 9C.

Figures 10A, 10B, 10C, 10D:
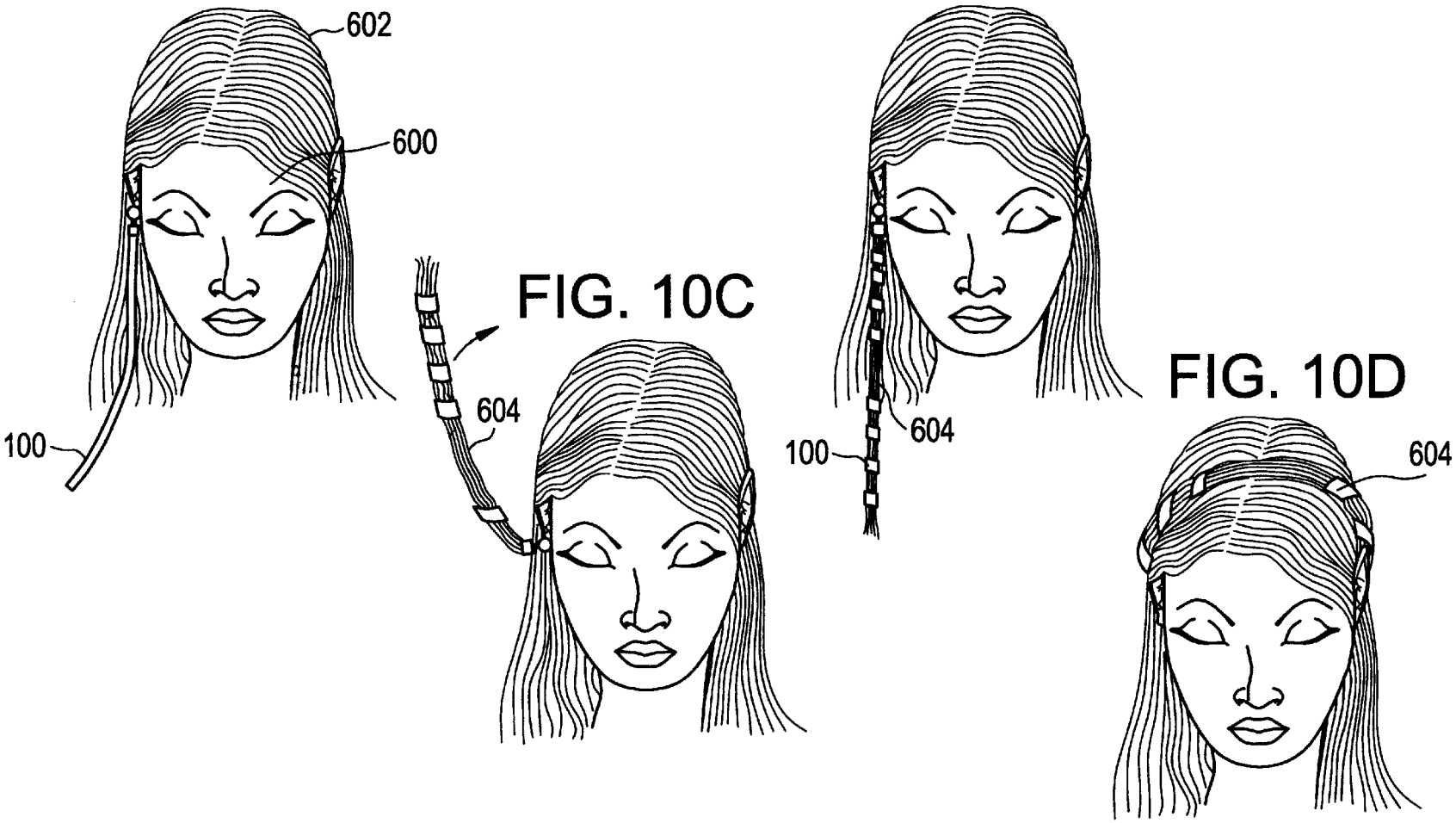
FIGS. 10A–10D are perspective views showing a method of use of the hair styling apparatus of the present invention with a hair tail.

A typical sequence of steps for practicing a third method of the current invention is best seen in FIGS. 10A–10D. The hair styling apparatus 100 of FIG. 1 is used to practice this method. A front view of a user's head 600 is shown with hair 602. A plurality of hair strands adjacent the user's temple are grasped as shown in FIG. 10A. Hair styling apparatus 100 is wound around the hair strands to form hair tail 604 as seen in FIG. 10B. Hair tail 604 is wrapped over the user's head 600 adjacent the user's forehead as shown in FIG. 10C. The end of hair tail 604 is then secured to the user's hair adjacent the user's other temple as shown in FIG. 10D.

Our method and apparatus for hair styling will be readily understood from the foregoing description. Furthermore, while the invention has been shown and described with respect to certain preferred embodiments, it is obvious that equivalent alterations and modifications will occur to others skilled in the art upon the reading and understanding of the specification. The present invention includes all such equivalent alterations and modifications, and is limited only by the scope of the appended claims.

What is claimed is:

1. A hair styling apparatus, comprising:

a plurality of elongate, in extensible members;

an elongate fabric strip;

said plurality of elongate, in extensible members and said fabric strip spirally wound to form an elongate body with said fabric strip forming a sheath having a textured surface substantially covering said elongate body;

said elongate body having a first end and a second end;

said first end of said elongate body has an elastic loop attached thereon; and, said sheathed elongate body wound around a user's hair to bind and hold said user's hair in a preferred position.

2. A hair styling apparatus according to claim 1 wherein:

said second end of said elongate body has a bead attached thereon.

3. A hair styling apparatus according to claim 1 wherein:

said second end of said elongate body has a hair clasp attached thereon.

4. A hair styling apparatus according to claim 1 wherein:

said second end of said elongate body has a termination end and an ornament attached thereon.

5. A hair styling apparatus according to claim 4 wherein:

said ornament is removably attached to said second end.

6. A hair styling apparatus, comprising:

a fabric strip wound with an elongate member to form a sheathed elongate member with a textured surface substantially covered by said fabric strip;

said sheathed elongate member folded in half to form first and second halves;

an elastic hair retaining loop positioned within said fold between said first and said second halves;

said elastic hair retaining loop retained within said fold between said first and said second halves of said sheathed elongate member; and, said first and said second halves of said sheathed elongate member wound together around a user's hair to bind and hold said user's hair in a preferred position.

7. A hair styling apparatus according to claim 6, wherein:

the ends of said first and said second halves opposite said fold between said first and said second halves of said sheathed elongate member have a bead attached thereon.

8. A hair styling apparatus according to claim 6, wherein:

the ends of said first and said second halves opposite said fold between said first and said second halves of said sheathed elongate member have a hair clasp attached thereon.

9. A hair styling apparatus according to claim 6, wherein:

the ends of said first and said second halves opposite said fold between said first and said second halves of said sheathed elongate member have a termination end and an ornament attached thereon.

10. A hair styling apparatus according to claim 9 wherein:

said ornament is removable attached to said termination end.

11. A method of hair styling using a hair styling apparatus, said hair styling apparatus comprising:

a plurality of elongate, inextensible members;

an elongate fabric strip, said plurality of elongate, inextensible members and said fabric strip spirally wound to form an elongate body with said fabric strip forming sheath substantially covering said elongate body;

said elongate body having a first end and a second end;

said first end of said elongate body has a bead attached thereon; and, said method of hair styling comprising the steps of;

forming a pony tail from a portion of the user's hair;

inserting said pony tail through said elastic loop and sliding said elastic loop to the upper end of said pony tail; and, wrapping said hair styling apparatus around said pony tail.

12. A method of hair styling using a hair styling apparatus, said hair styling apparatus comprising:

a plurality of elongate, inextensible members;

an elongate fabric strip, said plurality of elongate, inextensible members and said fabric strip spirally wound to form an elongate body with said fabric strip forming a sheath substantially covering said elongate body;

said elongage body having a first end and a second end;

said first end of said elongate body has a bead attached thereon; and, said method of hair styling comprising the steps of;

forming a top pony tail from a portion of a user's hair;

inserting said top pony tail through said elastic loop and sliding said elastic loop to the inner end of said pony tail; and, wrapping said hair styling apparatus around said top pony tail to form adjacent loops to support said top pony tail in a vertical orientation.

13. A method of hair styling using a hair styling apparatus, said hair styling apparatus comprising:

a plurality of elongate, inextensible members;

an elongate fabric strip, said plurality of elongate, inextensible members and said fabric strip spirally wound to form an elongate body with said fabric strip forming a sheath substantially covering said elongate body; and, said elongate body having a first end and a second end with a bead attached thereon;

said method of hair styling comprising the steps of;

grasping a plurality of hair strands adjacent a user's temple;

wrapping said hair styling apparatus around said plurality of hair strands to form a hair tail;

wrapping said hair tail over said user's head adjacent said user's forehead; and, securing said hair tail to said user's hair adjacent said user's other temple.

* * * * *